United States Patent [19]

Hishimuma et al.

[11] Patent Number: 4,607,409

[45] Date of Patent: Aug. 26, 1986

[54] METHOD AND APPARATUS FOR PROCESSING TEXTILES

[75] Inventors: Sumio Hishimuma, Shiga; Katsuo Kanno, Otsu, both of Japan

[73] Assignee: Toray Industries, Inc., Japan

[21] Appl. No.: 716,925

[22] Filed: Mar. 28, 1985

Related U.S. Application Data

[63] Continuation of Ser. No. 523,275, Aug. 15, 1983, abandoned.

[30] Foreign Application Priority Data

| | | | |
|---|---|---|---|
| Aug. 16, 1982 | [JP] | Japan | 57-141023 |
| Mar. 11, 1983 | [JP] | Japan | 58-42663 |
| Mar. 18, 1983 | [JP] | Japan | 58-44466 |

[51] Int. Cl.[4] ..... D06B 3/28; D06B 23/00

[52] U.S. Cl. ..... 8/152; 68/13 R; 68/177

[58] Field of Search ..... 68/13 R, 38, 177, 178; 26/28; 8/151, 152, 158

[56] References Cited

U.S. PATENT DOCUMENTS

| | | | |
|---|---|---|---|
| 2,067,632 | 1/1937 | Hadley | 26/28 |
| 3,330,077 | 7/1967 | Kanbar et al. | 26/28 X |
| 3,894,318 | 7/1975 | Ito et al. | 26/28 |

FOREIGN PATENT DOCUMENTS 18556 6/1976 Japan .

*Primary Examiner*—Philip R. Coe

*Attorney, Agent, or Firm*—Wegner & Bretschneider

[57] ABSTRACT

A method and an apparatus for processing textile are disclosed. The method and apparatus particularly relate to raising or shearing textile by bringing it into contact with an abrasive surface by a flowing liquid. By such a technique, raising or shearing can be more uniform; dyeing or finishing can be combined simultaneously with raising or shearing and higher productivity can be achieved.

14 Claims, 8 Drawing Figures

PRIOR ART

METHOD AND APPARATUS FOR PROCESSING TEXTILES

CROSS-REFERENCE TO RELATED APPLICATION

This application is a continuation of co-pending application Ser. No. 523,275, filed Aug. 15, 1983, now abandoned.

FIELD OF THE INVENTION

The present invention relates to a method and an apparatus for processing textiles, and particularly to a process in which textiles are brought into contact with an abrasive surface by a flowing liquid and raising or shearing is carried out.

BACKGROUND OF THE INVENTION

Commonly practiced raising methods effect raising by allowing the textile to abrade against a brush, lightly oiled rotating sand paper roll or card cloth while the textile is kept dry and at room temperature. However, these methods entail the following problems: raising tends to be uneven because it is not easy to keep uniform contact pressure between the abrasive surface and textile. If uniform raising is intended, contact pressure must be as small as possible and contact times must be increased to an extreme extent, resulting in considerable lowering of productivity. Especially, in the case of polyester textiles, productivity is very low and the raised fibers easily cause pilling because of their high strength. Furthermore, uniformity and variety of the raised fibers are much inferior to textiles made of wool or cotton.

On the other hand, to improve the pilling resistance of a raised fabric, it is important to shear the raised fibers as short as possible. However, it is not only difficult to control the exact clearance between the cutting (shearing) knife and textiles, but also many factors which are difficult to control remain, such as sharpness of the cutting knife, shearing tension and textile thickness.

Recently, a method of raising in a dyeing machine with a special type of raising ring made of metal is disclosed in FIGS. 2 to 6 of Japanese Patent Publication No. 18556/76. This method has several improvements as compared with common practice as follows: friction coefficient is largely lowered in the liquid; contact times between the abrasive surface and textile are markedly increased by using a dyeing machine at high speed; and this method may be carried out in combination with dyeing.

However, in connection with achieving satisfactory and uniform raising efficiently, these methods have problems which still remain, in that the number and the length of the raised fibers cannot be easily controlled (the number is too small and the length is too large) and in that textiles are often broken before achieving sufficient raising because the raising ring has too coarse a surface. Moreover, the raising ring made of metal causes heavy abrasion, easily wears out and lacks resistance to chemical agents such as alkalis and acids which are often used in high temperature processing. Consequently, applications of these methods are extremely limited.

SUMMARY OF THE INVENTION

In view of this situation, the present inventors have devoted themselves to examinations of these problems and found an abrasive surface having excellent durability for use in textile raising.

The method of this invention pertains to the processing of textiles by bringing them into contact with an abrasive surface by means of a flowing liquid, particularly a liquid containing a dye and/or finishing agent. The processing may be carried out in a liquid-circular type processing apparatus. The method further involves placement of the abrasive surface in the path of the flowing liquid, and may be carried out by providing the abrasive surface on an inner wall of a liquid injection nozzle in the liquid flow path.

The invention also includes apparatus for carrying out the method described in this application, with the structural features disclosed and with further refinements as well. For example, the abrasive surface may be provided on a guide or roll in the liquid flow path. In particular, the abrasive surface may be a surface of a whetstone, as defined in this application, and it may be provided on a cylindrical flow path. In particular embodiments of this invention, the abrasive surface comprises particles having diameters of about 4 to 4000 microns; when metalic abrasive particles are used, they may have a Shore hardness of at least 50, and when ceramic abrasive particles are used, they may have a new Mohs' hardness of at least 5.

With the above-mentioned features, raising or shearing can be effected very efficiently and steadily, and uniform and high grade raised or sheared products can be offered.

It is also a feature of the present invention that in combination with the above-stated raising and shearing, it is now possible to carry out dyeing, weight reducing processing (alkali treatment for polyester textiles) and antistatic, water absorbing, water repelling, and soil proof finishes.

BRIEF DESCRIPTION OF THE DRAWINGS

FIG. 1 shows a partially sectioned the main body of a processing apparatus of the present invention.

DETAILED DESCRIPTION OF THE INVENTION

Figure 1:
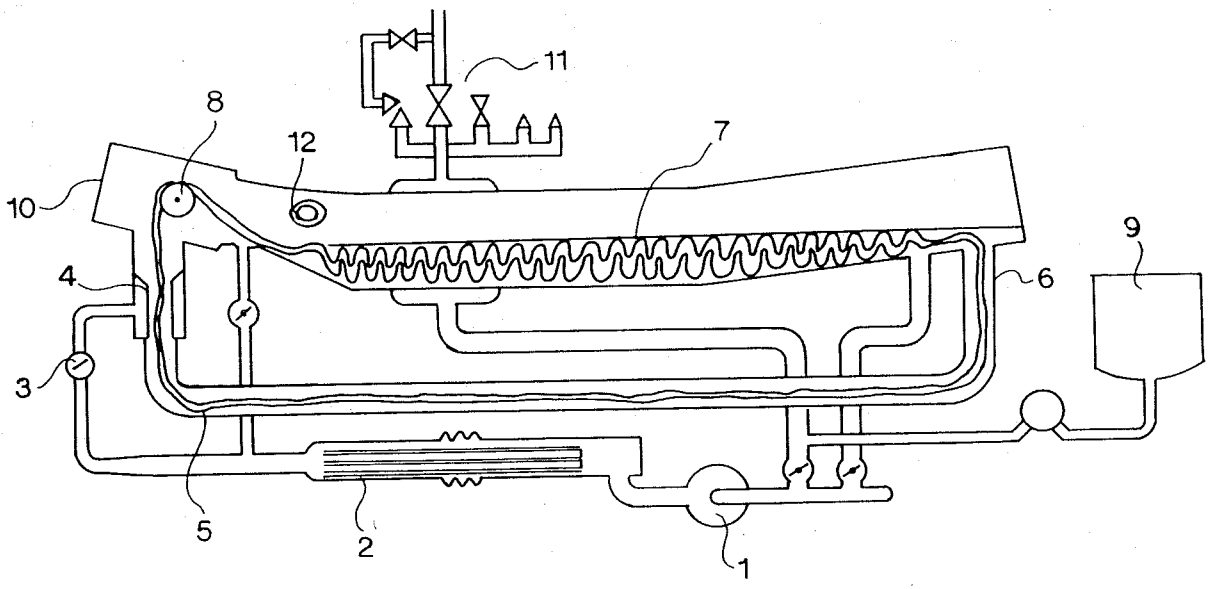
FIG. 1 is a views showing an embodiment of a liquid-flowing processing apparatus which is applied to the present invention.

Textile fabrics usable in the present invention include woven fabrics, knit fabrics, leathers, furs, unwoven fabrics, moquettes, carpets, etc., which consist of synthetic fibers such as polyester, polyamide, polyacryl, polybutylene, polypropylene, polyvinyl chloride, polyvinylidene chloride, polyurethane, etc., semi-synthetic fibers such as acetate, regenerated fibers such as rayon, cuprammonium rayon etc., single fibers comprising natural fibers such as wool, cotton, hemp and fur and mixed fibers. Fibers and textiles adaptable for raising and shearing may be used without limitation. Among them, particular examples of the advantageous effects of the present invention are short fiber weaves of polyester, long fiber spun yarn weaves, artificial leathers made up of very thin unwoven sheet, weaves using very fine fibers, tricot of polyamide and circular knits of polyacrylic. There are also included among them strong twisted de Chine and crepes which are capable of giving discriminative goods when only tips of crimps are raised.

The abrasive surfaces used in this invention comprise metallic or ceramic hard particles. Preferably, hard particles having a Mohs' hardness at least 5, such as metallic particles of bronze, stainless steel or ceramic particles of apatite, orthoclase, fused silica, quartz, topaz, garnet are used. More preferably, ceramic particles having a new Mohs' hardness of 11 to 15, such as fused zircon, tantalum carbide, fused alumina, tungsten carbide, silicon carbide, boron carbide and diamond are used. Preferably, the particle shape is sharp edged and the particle size is #8 to #3000, which corresponds to particle diameters of 4 to 4000$\mu$.

Preferable sizes are #100 to #800 for polyester fabric, #80 to #400 for polyacrylic knits and #100 to #300 for wool fabric of medium thickness.

Another feature of the present invention is the use of an abrasive surface made of whetstone. This whetstone, which is subjected to compression, high temperature heat treatment, sintering and molding, consists of three elements, namely abrasive particles, binders and pores. Therefore, it suffers very little wearing out and shows high durability even while undergoing contact in a liquid, as compared with grinding cloths or paper comprising metal or emery. Even if some abrasive particles are scraped off when binding power is weak and wearing out results, since abrasive particles are replaced in succession, a fresh surface is provided constantly. The pores serve to exclude chips and to prevent the whetstone from becoming clogged or worn out. In the present invention, owing to the effect of cleaning by the circulating liquid, there is almost no clogging, and if there is any, it can be solved with ease by grinding the whetstone with a coarse grinding paper. In addition, since it has good workability, the whetstone can be easily manufactured or molded in cylindrical form or plate-like form suitable for a nozzle or a pipe, as described later. It can also be used semipermanently because of ease of attaching, thereby resulting in considerable reduction in processing costs.

The whetstone of the present invention is defined in this application as being a rigid solid whose abrasive surface is molded using abrasive particles having edges tough and sharp enough to do damage such as cutting, injury or breakage to single fibers constituting the textile which is subjected to raising or shearing by contact with the abrasive surface. Specific are vitrified whetstone, shellac whetstone, rubber whetstone, bakelite whetstone, REDMANOL whetstone, resinoid whetstone, magnesia whetstone, etc., which are molded using abrasive particles having the a Mohs' hardness of 5 to 10, such as apatite, orthoclase, fused quartz, rock crystal, topaz, garnet, etc., or abrasive particles having a new Mohs' hardness of 11 to 14, such as fused zircon, tantalum carbide, fused alumina, tungsten carbide, silicon carbide, boron carbide, etc. Metal particles having a Shore hardness of at least 50 are also suitable.

Other than whetstones as mentioned above, the present invention includes moldings consisting of kaolin, porcelain, castings, ceramic, cement, etc., and more preferably includes whetstones consisting of A abrasive particles or WA abrasive particles in which crystalline alumina is sintered with binding agents such as epoxy resin, kaolinite or sodium silicate, and whetstones consisting of C abrasive particles or GC abrasive particles with which silicon carbide is combined. The latter has sharp abrasive particle edges as compared with the former. In any case, they are rigid and very durable even when strong bases, strong acids or organic solvents are used as the process liquid at high temperatures up to 100° to 130° C. Additionally, they are not contaminated with dyes and are easy to handle because they do not exude into the liquid.

An abrasive surface made of such whetstones is attached to the textile fabric travelling path in a liquid-flowing type processing apparatus as explained later, and raising is performed. It appears, however, that when textile is processed in a rope form, there may be a problem involved in uniformity of nap.

However, when textile fabric is passed through a liquid injection nozzle to which an abrasive surface is attached, close buckling develops in the textile fabric and abrasive particles of the whetstone come into contact microscopically with fibers in the minute clearances between the buckled fibers, and hence the uniformity of the textile becomes very good. Therefore, there results a surprising effect that is incomparably superior to the so-called "coarse" rough contact surface in which metal tubes or metal rings are impressed with linear streaks are attached thereto. In this connection, nap processed according to the present invention is very fine and increased in uniformity while having high density, as compared with that produced by the abrasive surfaces of metal tubes. In any case, since the characteristics of whetstone vary with abrasive particle size, binding agent, and sintering condition, an adaptable whetstone may be selected suitably according to nap properties or the processing conditions needed for textile. In this connection, abrasive particle size (Number) of artificial whetstone shown in JIS specification is #8 to #3000, covering abrasive particle sizes of 4000 to 4$\mu$, and is capable of coping well with almost all requirements for nap properties.

The method suitable to the present invention for processing textile while allowing it to travel in a liquid may include any methods for processing textile through a liquid, such as a padder, wince, jigger, liquid-flowing dyeing machine, or relaxer.

In such methods, abrasion mechanisms properly compatible with these various types of methods can be provided with an abrasive surface of whetstone of the present invention on the surface of a textile fabric travelling path, irrespective of continuous or intermittent type.

For example, the abrasion mechanism by an abrasive surface to the padding can be achieved by providing an abrasive surface to a textile travelling roll in a process liquid or to at least one of the rolls after the textile is drawn up, and by rotating the roll, giving it a time lag behind the travelling speed of textile. In this case, the raising or shearing of the present invention can be effected by separately providing a textile travelling path in a process liquid or after processing with a molding made of whetstone, such as plate-like form, cylindrical form or form with slit, namely a molding having a path through which textile can travel, and by bring textile to contact with the molding. In other cases such as in the jigger, wince and relaxer, the same object can also be achieved by providing a similar whetstone mechanism.

Among these processing methods, a liquid-flowing processing apparatus for processing textile while allowing it to travel along with flowing liquid, such as a liquid-flowing dyeing machine is superior in the raising or shearing effect when used with the present invention.

The liquid flowing processing apparatus as mentioned above is defined as follows:

> "A circulation processing apparatus containing a section in which a fiber product such as textile fabric linked in loop form is allowed to stay at one time while travelling in zigzag in a process liquid and another section in which the product is transferred and travelled along with a rapidly flowing process liquid, and being provided in textile fabric transferring and travelling paths with rough surfaces."

Specific samples include liquid-flowing type dyeing machines on the market, such as "Circular" (manufactured by Nichihan Seisakusho), "Uniace" (manufactured by Nippon Senshoku Kikai), "Dashline" (manufactured by Oshima Kikai), "Masuflow" (manufactured by Masuda Seisakusho) and "Jetdyeing Machine" (manufactured by Gustone Co.). The present invention is not limited to said dyeing machines, but it is also a feature of the invention that these existing dyeing machines can be applied according to the invention. The liquid-flowing type dyeing machine, as is generally known, is capable of processing at high temperatures and high pressures and giving wrinkling with low tension and has excellent resistance to chemical agents such as alkalis. Consequently, there can be carried out, not to speak of raising, other dyeing processes such as weight reducing and dyeing in combination with raising, and hence the effect of the present invention can be fully exhibited thereby.

The apparatus and method of the present invention will be better understood from the following description connection of the liquid-flowing type dyeing machine taken in conjunction with FIGS. 1 to 5.

Figure 2:
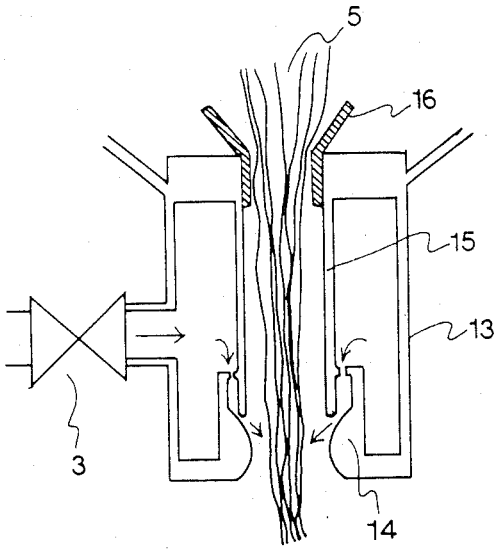
FIGS. 2 and 3 show sectional views of the sections of the liquid injection nozzle of FIG. 1 to which abrasive surfaces of whetstone are attached.
Figure 3:
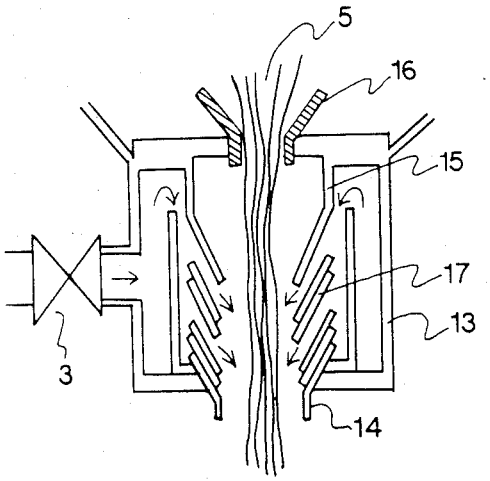

FIG. 1 shows a general view (side view) of the apparatus. A process liquid, which is sent from a pump 1 and heated by a heat exchanger 2, is injected into a cylindrical flow path 6' from an nozzle 4 after passing through a nozzle valve 3. Textile fabric 5 linked in loop forms is passed counterclockwise through a lower tube 6 and transferred to a residence section 7 under the pressure of the flowing liquid. The textile fabric is thus processed while circulating. In this figure, above the nozzle 4 is a drive reel 8 provided for smooth travel of textile fabric, 9 is a charging tank to charge dyes, chemical agents, etc., 10 is an opening for inlet and outlet of textile fabric, 11 is an air pressure valve, and 12 is a peeping window made of pressure-resisting glass. FIGS. 2 and 3 are enlarged views of a liquid injection nozzle. After passing through the nozzle valve 3, the process liquid is injected through a clearance between a nozzle boss 14 and a nozzle pipe 15 which are provided in the nozzle case 13 and the textile fabric is allowed to vertically travel along with the process liquid. In the figures, numeral 16 is a funnel shaped cylindrical tube which is a guide pipe to allow textile fabric to travel smoothly and has an abrasive surface on the inner surface of it. The process liquid flows simultaneously with textile fabric from above the funnel shaped cylindrical tube 16. FIG. 3 shows a different kind of the nozzle in FIG. 2. The part designated as 17 is an example of liquid injection multistages of nozzle pipes.

Figure 4:
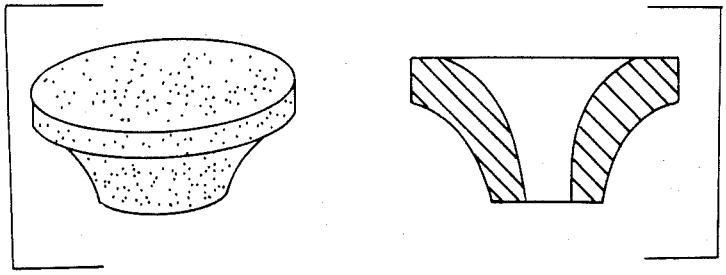
FIGS. 4, 5 and 6 show examples of nozzles and rings made of whetstone.
Figure 5:
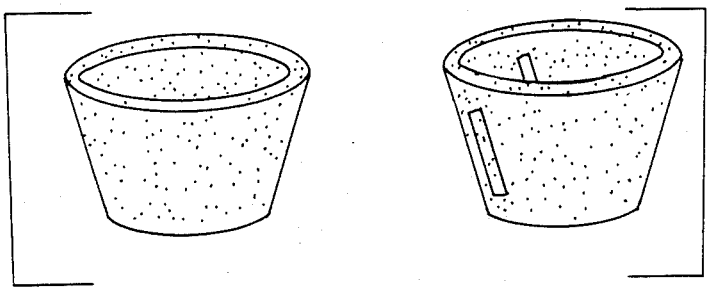
Figure 6:
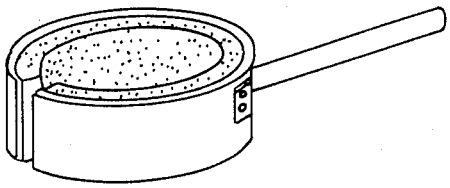
Figure 7:
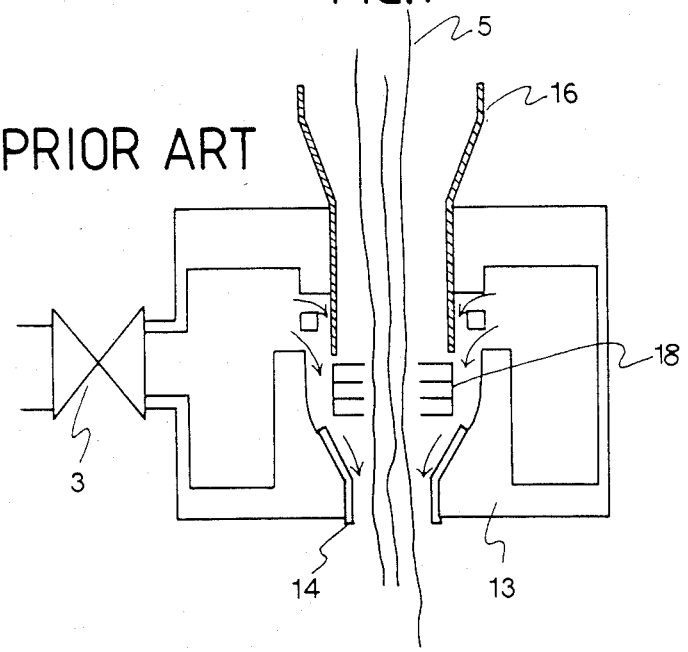
FIG. 7 PRIOR ART
FIGS. 7 and 8 show the injection nozzle and the raising ring, respectively, taught in the prior art, Japanese Patent Application Publication No. 18556/76.
Figure 8:
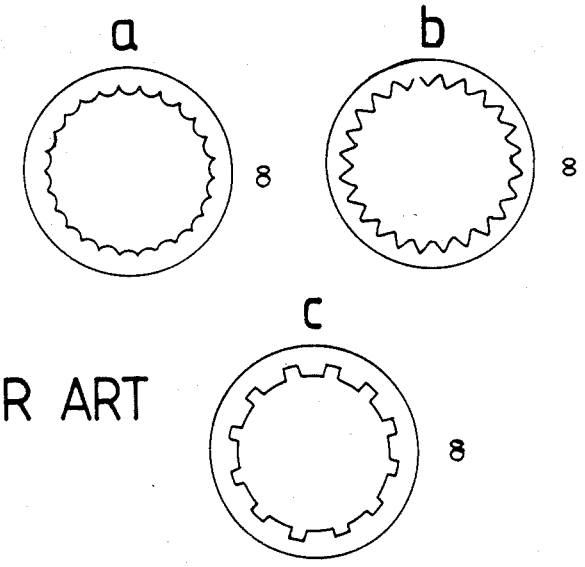

In the present invention, provided that it is on the travelling surface of textile, an abrasive surface of the whetstone according to the present invention may be provided in any place or on any device within the apparatus. The general location for placement of the abrasive surface is shown by the heavy lines in FIG. 1. In order to obtain distinctive nap with maximal efficiency, however, it is preferable to manufacture and use such devices of whetstone as shown in FIGS. 4 to 5. It is a matter of course that these devices are manufactured and attached with ease. The horn-shaped pipe in FIG. 4 and the multi-stages nozzle pipe in FIG. 5 in which textile fabric is inserted and allowed to travel, permit satisfactory achievement of the object even when they are used separately. However, adequately combined use of them is an interesting method that high diversification of nap can be further pursued. FIG. 6 shows an example of a hollow ring to be provided between the drive reel 8 and nozzle 4. This is a very useful ring through a clearance of which textile fabric may be detached depending upon nap under processing. FIGS. 7 and 8 depict respectively the injection nozzle and the raising rings shown in the apparatus of Japanese Patent Application Publication No. 18556/76. In this prior art device, a raising ring 18 is used rather than the multistage nozzle pipe 17 used in the apparatus of the present invention as shown in FIG. 5. The other elements are common to the apparatus of the present invention and therefore have the same element numbers.

The specific methods and effects of the present invention are as follows:

(1) Uniform raising can be achieved. In the above-mentioned liquid-flowing type dyeing machine, speed of textile fabric is 100 to 300 m/min for the common type and 500 and 800 m/min for the high speed type, and the number of times of contact with abrasive surface can be very high as compared with ordinary raising. In addition, "DYEING WITH UNCOLORED SPOTS" of textile fabric can be regulated depending upon the size of nozzle and contact pressure can be controlled. Furthermore, since the contact areas of textile fabric, which is processed in loop form, vary continuously for each circulation, uniformity of nap can be increased remarkedly, coupled with the effect of the microscopic contacts of abrasive particles as stated above.

(2) Other processes can be combined simultaneously with raising. In many cases where the raising industry depends characteristically upon rule of thumb, raising is separated as a divided work from common dye processing, with the result that no integrated work covering dye finishing can be accomplished. However, this problem can be solved by the present invention. It covers a wide range of the following processing techniques which can be applied to almost all methods of processing textile fabric in liquid and permit combinations of these methods: a process to obtain better hand of polyester by alkali weight reducing; sharpening of nap points or mercerizaton of cotton; dyeing at the same time with felting of wool; distinctive raising of synthetic fibers while being allowed to develop shrinkage; combined use in liquid of processes for softness, water repelling and water absorption, for example, giving such functions to one by one of nap.

(3) High productivity can be achieved. Because of high speed of the process as mentioned above, an efficiency 4 to 10 times higher at practical levels than ordinary raising processes carried out while the textile fabric is kept dry and at room temperature (process speeds of the order of 10 m/min) can be obtained.

(4) Raising can be accomplished with ease. The attachment and detachment of an abrasive surface made of whetstone are very simple, and existing liquid-flowing type dyeing machines can be employed with no special or large scale apparatus being needed.

(5) Nap with diversification can be obtained. Regulation of the liquid flow nozzle makes it possible for textile fabric to have a variety of wrinklings, and nap with not only one directionality but also multi-directionality can be developed. Combinations of rough surfaces can develop a nap enriched in elegance in which long and short nap are mixed.

(6) Costs of processing are low. Cost reduction is expected by rationalization of the process through combined use of the dyeing processes as stated previously. There is needed no use of static electricity removing apparatus, temperature regulating apparatus or dust collector for suspended nap required by conventional raising. The whetstone used for abrasive surface is very inexpensive and its working cost is also minute.

The present invention will now be illustrated by the following examples. Of course, the invention is not limited to these examples.

EXAMPLE 1

A twilled weave was made by using as warp and weft mixed and false twisted fibers of polyester consisting of 18 filaments of 150 denier and 96 filaments of 150 denier. After scouring and setting by an ordinary method, raising was carried out in the liquid-circular type dyeing machine "Circular" RS type (manufactured by Hisaka Seisakusho) as shown in FIG. 1, in which a manufactured horn-shaped pipe made of whetstone as shown in FIG. 4 was attached to said dyeing machine (processed length: 200 m), in accordance with the method by the present invention. The whetstone used was made of A abrasive particles of #600 consisting of sintered crystalline alumina with a new Mohs hardness of 12, and worked into the funnel-shaped cylindrical tube having an outside diameter of 70 mm $\phi$, an inside diameter of 150 mm $\phi$, thickness of 15 mm and height of 120 mm. The process was carried out under the following conditions: temperature elevation time: 40 min, 135° C.×20 min; speed of textile: 400 m/min; times of passage through nozzle: 120. Fluffing was made simultaneously with dyeing (a common disperse dye used).

As Comparative Example 1 on the other hand, the weave used in the present invention (processed length: 200 m), after having been subjected to a common cut raising (raising machine: TOMLINSON Co., UK; times of raising: 20; speed of textile: 15 m/min (one side raising)), was dyed in accordance with Example 1, except that the weave was processed without being brought into contact with an abrasive surface.

As Comparative Example 2, the aforesaid twilled weave (processed length: 200 m) was subjected to the raising process according to Example 1, in which the whetstone was replaced with a horn-shaped pipe made of metal having the same size as Example 1 which has many oblique grooves of 2 mm depth and 2 mm of pitch on its inner surface. Subsequently, a finishing process based on ordinary methods was applied to the work processed by the present invention as well as to those processed by Comparative Examples 1 and 2.

The results of Comparative Example 1 were as follows: lack of uniformity of nap; short length of nap; a little unsatisfactory quality of nap; and poor productivity. Production time taken for the raising process (one side processing) was 4.4 hours, 1.0 hour for the dyeing process, 5.4 hours in total.

In Comparative Example 2, the inner surface of the horn-shaped pipe was found to be worn out. This might be why the nap lacked uniformity. The production efficiency was close to a satisfactory level but not to perfection because of poor workability since cutting the grooves in the horn-shaped metal pipe is not easy and replacement thereof after the process were required.

By contrast, in the present invention, the nap developed uniformly on both sides of textiles, was somewhat longer in length than those of Comparative Examples 1 and 2, and had an elegant quality. Since raising and dyeing were carried out at the same time, the production was completed in a very short time with high efficiency, that is, the time taken for it was 1/10 of Comparative Example 1 with only 1.0 hour required for the dyeing process. The horn-shaped pipe made of whetstone used showed little abrasion, wear and dyeing through use, and was found to be highly durable without any impregnation into the dyeing solution. Thus a smooth processing was accomplished.

EXAMPLE 2

MATWOOSE weave was produced by using as warp and weft cover yarn with false twisted yarn of polyester consisting of 72 filaments of 150 denier as the core and with thinnest yarn of polyester consisting of 96 filaments of 75 denier as the sheath. After relax scouring and intermediate setting by an ordinary method, said weave was subjected to raising in the liquid-flowing type dyeing machine "UNIACE" (manufactured by Nippon Senshoku Kikai) as shown in FIG. 1 while being allowed to contact with a manufactured hollow ring of whetstone as shown in FIG. 6, which was attached halfway between the drive reel and the nozzle in said dyeing machine (processed length: 200 m). The whetstone used was made of C abrasive particles of #800 consisting of sintered silicon carbide abrasive particles having a hardness of 13 and worked into a ring having an inside diameter of 70 mm $\phi$, outside diameter of 100 mm $\phi$, a thickness of 20 mm and a height of 20 mm. The process was carried out under the conditions of alkali weight reducing followed by dyeing. These processes were performed at the same time with raising, following the method by the present invention. The weight reduction was carried at 100° C. for 20 min using a 2% aqueous solution of caustic soda and its rate was 8%. The dyeing was effected using a common dispersion dye under the condition of a temperature elevation of 40 min and 135° C.×20 min.

As Comparative Example 3, both sides of the MATWOOSE weave (processed length: 200 m) used in the present invention were subjected 2 times each to a common buffing process (sand paper: #180 (manufactured by Okamoto Riken)). Subsequently, with no abrasive surface attached, the resulting product was subjected to the alkali weight reducing process and dyeing process in accordance with Example 2.

Example 2 in accordance with the present invention and Comparative Example 3 were then finished by an ordinary method.

In Comparative Example 3, there resulted uneven nap with lengthwise streaks, the length of nap was at random and the quality and touch of nap were less than satisfactory. In addition, the production process took a long time and since no buffing machine was provided in the same plant, integrated processing was not possible, resulting in considerable inconvenience. By contrast, in the present invention, the weave had a close nap of thinnest yarn developed uniformly on its both sides, and had extremely excellent texture and appearance. An integrated processing, in which raising was combined with weight reducing and dyeing processes, was accomplished with high productivity. The ring made of whetstone showed no abrasion and wearing out and could be used repeatedly even in subsequent processing. It is a matter of course that throughout the processes, there was no trouble and smooth processing was achieved.

EXAMPLE 3

Dyeing (temperature elevation: 60 min; 120° C.×40 min; a disperse dye used) was carried out using 200 m of unwoven fabric (unit weight: 280 g/m$^2$; thickness: 7 mm; polyurethane: 42 wt %) in which needle felt consisting of thinnest yarn (0.1 denier) of polyester had been impregnated with polyurethane. At the same time, raising was carried out at a textile fabric speed of 200 m/min using the liquid-flowing type dyeing machine "Circular" RA type (manufatured by Hisaka Seisakusho) as shown in FIG. 1, in which 3 nozzle pipes of whetstone as shown in FIG. 5 were used, in accordance with the method by the present invention. The whetstones, which were made of A abrasive particles of #100, #240 and #400 respectively in accordance with Example 1, were used in an arrangement of 3 stages. With the exception of difference in abrasive particle size, the nozzle pipes were made same as Example 1: inside diameter of 70 mm $\phi$, outside diameter of 90 mm $\phi$, thickness of 10 mm and height of 80 mm. After raising and dyeing, a common finishing method was applied.

The present invention was compared with Comparative Example 4 of an ordinary product (buffing-dyeing-finishing).

In Example 3, the nap was somewhat longer in length than that of Comparative Example 4, and had very distinctive quality with multi-directionality. The nap also had adequate resiliency and excellent texture enriched in soft feeling. These features, coupled with the characteristic fluffy feeling, made it possible to obtain a ultra-high quality, furry to the touch, ultrathin raised nap sheet, which was not attainable by the conventional techniques. The nozzle pipe used suffered no abrasion, wearing out on dyeing and had durability enough to permit its repeated use permanently.

EXAMPLE 4

A broad weave was made by using as warp and weft 40/s spun yarn consisting of 1.3 denier, 44 mm polyester staple. After scouring and setting by an ordinary method, shearing was carried out in the liquid-circulating type dyeing machine "UNIACE" type (manufactured by Nihon Senshoku Kikai), in which a funnel-shaped cylindrical tube covered with abrasive paper of #600 (manufactured Okamoto by Riken) was attached to said dyeing machine as shown in FIG. 2 (processed length: 200 m). (the method by the present invention). The abrasive paper used was made of C abrasive particles of silicon carbide of 40$\mu$ average diameter sintered with kaolinite. The funnel-shaped cylindrical tube has an outside diameter of 100 mm $\phi$, an inside diameter of 50 mm $\phi$, a thickness of 15 mm and a height of 120 mm. The process was carried out under the following conditions: temperature elevation time: 40 min, 100° C.×20 min; speed of textile fabric: 400 m/min; times of passage through nozzle: 120. Shearing was made simultaneously with weight reducing treatment in 0.6% NaOH aquous solution. Next the textile fabric was dyed with ordinary disperse dye, and finished.

On the other hand, as Comparative Example 5, the weave used in Example 4 (processed length: 200 m), was subjected to a common shearing machine (manufactured by SELLERS, West Germany) under the following condition: times of shearing: 2; speed of textile fabric: 7 m/min. Then the weave was dyed and treated with alkali in accordance with Example 4, except that the weave was processed without being brought into contact with an abrasive surface.

The results of Comparative Example 5 were as follows: nap is too long and lack of uniformity; a little unsatisfactory quality of nap; and poor productivity. Production time taken was 114 minutes for the shearing process, 1.0 hour for the dyeing for the alkali treatment process, and totally 174 minutes. Further the pilling resistance of this fabric was 2nd grade which is unsatisfactory for ordinary use (tested under Japanese Industrial Standard L1076(A method)).

By contrast, in Example 4 of the present invention, nap almost perfectly disappeared on both sides of textile fabric. Since shearing and weight reducing treatment were carried out at the same time, the production was completed in a very short time with high efficiency, that is, the time taken for it was $\frac{1}{3}$ of Comparative Example 5. Further, the resulting textile fabric of Example 4 showed pilling resistance of 5th grade, tested according to the method used in Comparative Example 5, which is satisfactory for ordinary use, and smooth, high quality surface appearance.

We claim:

1. A method for processing textiles comprising passing said textile through a cylindrical tube, the inner wall of which comprises abrasive particles thereby forming an abrasive surface, with a flowing liquid under conditions such that said textile is brought into contact with said abrasive surface while moving through said tube to thereby raise or shear said textile by said abrasive surface.

2. The method for processing textiles of claim 1, wherein the liquid is a liquid containing a dye and/or a finishing agent.

3. The method for processing textiles of claim 1, wherein the processing is carried out in a liquid-circular type processing apparatus.

4. A liquid-flowing type apparatus for processing textiles comprising means providing a path through which said textile passes, means providing a flowing liquid for passage through said path means, and an inside wall of said path means comprising abrasive particles for contacting said textile and causing the same to be raised or sheared.

5. The liquid-flowing type processing apparatus of claim 4, wherein the abrasive surface is provided on an inner wall of a liquid injecting nozzle in said path means.

6. The liquid-flowing type processing apparatus of claim 4, wherein the abrasive surface is provided on a guide or roll in said path means.

7. The liquid-flowing type processing apparatus of claim 4, wherein the liquid-flowing type apparatus is a liquid-circular type apparatus.

8. The liquid-flowing type processing apparatus of claim 4, wherein the abrasive surface is a surface of whetstone.

9. The liquid-flowing type processing apparatus of claim 4, wherein said path means is a cylindrical path.

10. The liquid-flowing type processing apparatus of claim 4, wherein the abrasive surface comprises abrasive particles having a diameter of about 4 to 4000 microns.

11. The liquid-flowing type processing apparatus of claim 10, wherein the abrasive particles are metallic particles having a Shore hardness of at least 50 or ceramic particles having a new Mohs' hardness of at least 5.

12. The method of claim 1, wherein said abrasive surface is a surface of whetstone.

13. The method of claim 1, wherein said abrasive surface comprises abrasive particles having a diameter of about 4 to 4000 microns.

14. The method of claim 13 wherein said abrasive particles are metallic particles having a shore hardness of at least 50 or ceramic particles having a new Mohs' hardness of at least 5.

* * * * *